United States Patent [19]

Walker

[11] Patent Number: 5,050,889

[45] Date of Patent: Sep. 24, 1991

[54] PORTABLE TOSSING GAME AND TARGET ASSEMBLY

[76] Inventor: Kevin M. Walker, Charleston Air Force Base, S.C.

[21] Appl. No.: 576,064

[22] Filed: Aug. 31, 1990

[51] Int. Cl.[5] ..... A63B 67/06

[52] U.S. Cl. ..... 273/402

[58] Field of Search ..... 273/402, 408, 348; 403/409.1, DIG. 10

[56] References Cited

U.S. PATENT DOCUMENTS

| | | | |
|---|---|---|---|
| 1,636,920 | 7/1927 | Nichols | 273/402 |
| 2,088,755 | 8/1937 | Malone | 403/409.1 |
| 3,837,650 | 9/1974 | Haney | 273/402 |
| 3,876,070 | 4/1975 | Nagy | 273/348 X |
| 4,243,229 | 1/1981 | Huser et al. | 273/402 |
| 4,372,560 | 2/1983 | Antonius | 273/408 |
| 4,961,586 | 10/1990 | Conville | 273/402 |

*Primary Examiner*—William H. Grieb

[57] ABSTRACT

A gameboard assembly is disclosed which comprises an inclined gameboard including a hole and a tab at the rearward edge for insertion through a horizontal slot near the base of a vertically standing backboard which connection is maintained by wedge pieces inserted in slots in the gameboard tab portion extending through the horizontal slot in the backboard.

8 Claims, 1 Drawing Sheet

PORTABLE TOSSING GAME AND TARGET ASSEMBLY

BACKGROUND OF THE INVENTION

1. Field of the Invention

This invention relates generally to a game and a game device, more particularly to a disk throwing game and a receiving target including an inclined horizontal planar surface, and most particularly to a washer tossing game and an assembling/disassembling receiving target therefore, permitting portability.

2. Description of the Prior Art

Many games include one or more projectiles designed to be tossed by a player in the direction of a receiving target, often including graduated markings for scoring. The most familiar being various forms of the bean bag toss game. Other tossing games are disclosed in U.S. Pat. Nos. 1,636,920; 3,837,650; 3,876,070; and 4,372,560. Tossing games specifically including targets utilizing an inclined horizontal planar surface are taught in U.S. Pat. Nos. 406,342; 3,628,793; and 3,912,271. No known prior art game, however, offers the combination of commonly available playing pieces (i.e., washers), a portable, assembleable gameboard (i.e., target) and a simplified point system for scoring, requiring no developed skill or prior knowledge to immediately begin enjoying the game. An alternate scoring for advanced players permits continued challenge and perpetuates interest after an advanced level of skill is attained.

SUMMARY OF THE INVENTION

In the context of a tossing game, the invention target device comprises an inclined gameboard including a hole which is the object of the tossed projectile, and a tab at the rearward edge of the gameboard for insertion into a horizontal slot near the base of a vertically standing backboard which is held in place against the gameboard rearward edge by wedge pieces inserted in slots in the gameboard tab portion extending through the horizontal slot in the backboard. Optionally, multiple horizontal slots may be provided at different distances from the base of the backboard to permit varying the angle of incline of the gameboard depending on the slot chosen for the assembly. Also, supporting block pieces may be attached to the underside of the gameboard along its front edge, preferably at the corners thereof, to raise the front portion of the gameboard and to impact its angle of incline, if desired.

DESCRIPTION OF THE PREFERRED EMBODIMENT(S)

As required, detailed embodiments of the invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the invention in virtually any appropriately detailed structure.

Figure 1:
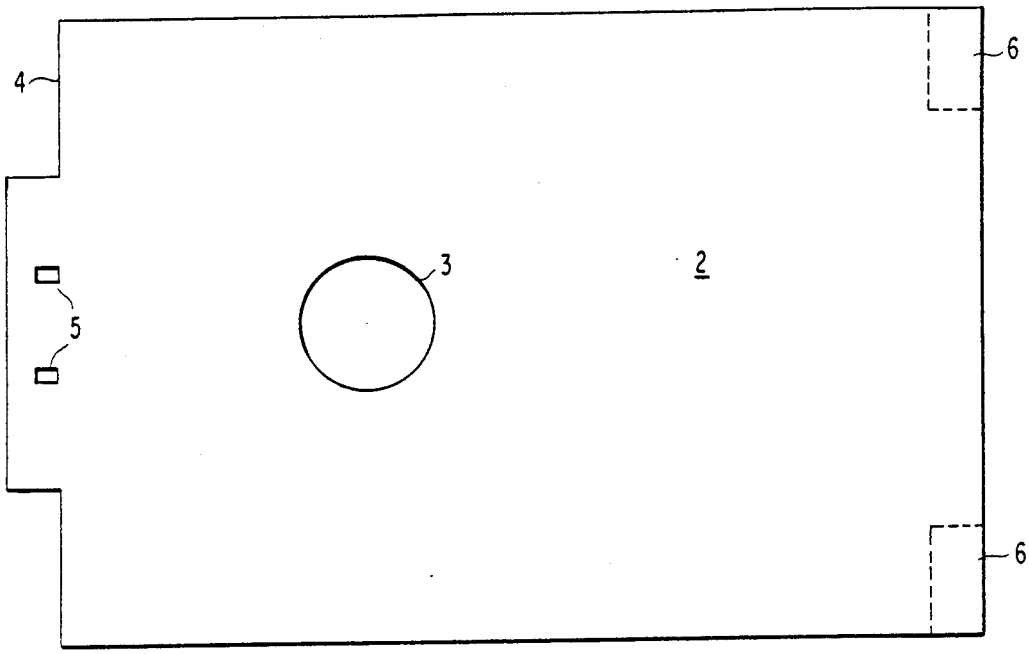
FIG. 1 depicts a top view of the target gameboard, or an inclined portion of the target, intended as the object of the tossed projectile, including a hole in the gameboard of a larger diameter than the diameter of the projectile tossed and a tab at the rearward edge of the gameboard for insertion into a horizontal slot provided at the base of a vertically standing backboard. The two small slots provided in the tab are designed to receive wedge stabilizers behind the backboard upon assembly of the target device.
Figure 2:
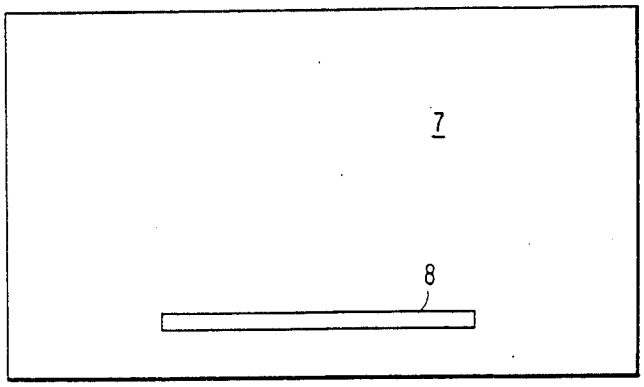
FIG. 2 depicts a front view of the vertically standing target backboard for deflecting the tossed projectile toward the gameboard and for supporting the gameboard by provision of a slot at its base for receiving the tab at the rearward edge of the gameboard.
Figure 3:
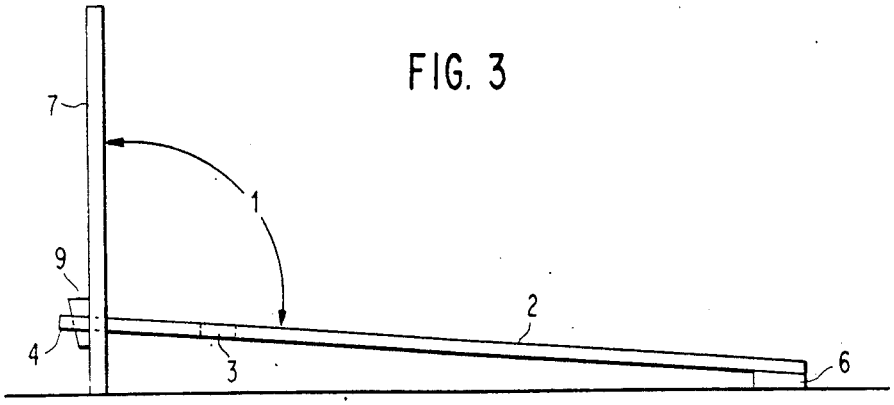
FIG. 3 is a side view of the assembled target device for the tossing game.

In the disclosed embodiment of the invention as depicted in FIGS. 1–3, the reference numeral 1 generally designates a game target assembly used by one or more players to score points as determined by the location of the impact of projectiles on the generally rectangular gameboard portion 2 of the assembly. The gameboard 2 is provided with a circular opening or hole 3, having a diameter larger than the diameter of the projectile game piece tossed in the direction of the target assembly 1. The gameboard is also provided with a tab extension 4 along the central portion of the rearward edge of the gameboard. The tab 4 contains at least one slot 5, preferably a rectangular slot the longitudinal axis of which is parallel to the longitudinal axis of the gameboard.

Preferably the tab 4 contains multiple slots 5, and, in the most preferred embodiment, the tab 4 contains two slots 5. Optimally, the gameboard 2 also is provided with at least one support structure 6 attached along the underside of the front edge of the gameboard 2. Preferably there are multiple support structures 6, and, in the most preferred embodiment, there are two support structures 6 with one each positioned located at opposite corners of the forward edge of the underside of gameboard 2.

The target assembly 1 also is comprised of a vertical standing backboard 7 of a generally rectangular shape. The backboard 7 further comprises at least one horizontal slot s centrally located near the base of the backboard. The slot 8 provides an opening just larger than the tab extension 4 of gameboard 2 to permit insertion of said tab 4 through said slot 8 to form the target assembly 1. In an alternate embodiment, the backboard 7 may comprise multiple horizontal slots 8 at different distances from the base of the backboard 7 to permit varying the angle of incline of the gameboard 2 depending on the slot 8 chosen for the assembly.

Although the angle of incline of the gameboard 2 may vary, the direction of incline will not. The direction of incline is always down from the rearward edge of the gameboard 2, or from the point of attachment of the gameboard 2 to the backboard 7.

To secure the attachment of the gameboard 2 to the backboard 7 in the target assembly 1, wedge pieces 9 are provided for insertion in the tab extension slots 5 upon attachment of the gameboard 2 to the backboard 7. The wedges 9 are inserted into the portion of slots 5 that extend beyond the plane of the backboard 7 through horizontal slot 8. To facilitate stabilizing the target assembly 1, the wedge pieces 9 preferably are shaped in the approximate form of a right triangle and inserted into the slot 5 in such a manner that the base of the right triangle form of the wedge pieces 9 is oriented upward.

Easy assembly of the target is accomplished by standing gameboard 2 on end with the rearward edge (including tab extension 4) pointing upward. Insert the tab 4 of the gameboard 2 through the horizontal slot 8 of the backboard 7. Finally, insert wedge pieces 9 into tab slots 5. The wedges 9 should be forced into the slots 5 to apply sufficient pressure against the back of the backboard 7 so that it is firmly against the rearward edge of the gameboard 2 to stabilize the target assembly 1 and to maintain the vertical alignment of the backboard 7 upon uprighting the assembled target 1. The ease of assembly/disassembly lends to the portability of the target assembly 1.

In connection With this target assembly 1, projectiles for tossing in the direction of the target are employed. Preferably, the projectiles are disk-shaped. Most preferably, the disk-shaped projectiles are common washers. The tossing game may be played by one or more players using a single target assembly 1. However, to increase the speed of play of the game, a second target 1 is assembled and positioned about fifteen feet away from and facing the first target assembly 1.

The game-playing target assembly 1 may be used in any desired manner with suitable rules established for turns and point values as determined by the location of the impact of the respective projectile on the gameboard 2. Any number of projectiles (in this example, washers) may be used. The preferred number is two washers per player. Players normally stand behind one target assembly 1 and toss the washers toward the opposite target assembly 1.

In a preferred set of rules, the game is started by each player tossing one washer to his opposite gameboard 2, and the player who tosses nearest the hole 3 begins the game. The following definitions apply: a "hanger" refers to the circumstance where a washer hangs over the hole 3; and a "sinker" refers to a washer falling through the hole 3. For flexibility and continued enjoyment upon developing skill in this tossing game, there are two scoring systems, as disclosed in the following examples.

Beginners

For each washer that stays on the gameboard, each player receives one point. The player with the washer nearest the hole receives two points for that washer. A "hanger" is good for three points, and a "sinker" is worth five points. Two sinkers are good for ten points; however, your opponent can cancel one or both sinkers by sinking his washers. Your opponent also can help you by knocking your washer closer to or even into the hole 3. The player closest to the hole 3 tosses first on the next turn. Play continues until one player, or team, reaches 21 points. You must win by two points.

Advanced

To score in the advanced version of the game, one washer must by within one washer diameter of the hole 3. If both players are within one washer diameter of the hole 3, the closest washer scores one point. A "hanger" is worth two points, and a "sinker" is worth three points. Your opponent can help or hinder you by knocking your washer closer to or farther away from the hole 5. Your opponent can cancel your sinkers by matching sinker for sinker. If there are any washers within one washer diameter of the hole 3, they would score according to the closest washer to the hole 3. The player closest to the hole tosses first on the next turn. Play continues until one player, or team, reaches eleven points. You only have to win by one point. If a player, or team, scores seven points before the other player, or team, scores any points, the game ends.

It is to be understood that the manner of use and the rules and regulations for playing the game can and will be varied as is generally permissible when using the target assembly 1 and devices of the character shown and described herein.

I claim:

1. An improved game-playing target assembly comprising a gameboard having an inclined planar surface including a circular hole of a size sufficient to permit a tossed projectile to pass through the hole and a backboard having a vertical planar surface, the improvement comprising at least one stabilizing wedge piece, a tab extending from the gameboard's rearward edge which tab includes at least one slot for receiving the wedge piece for stabilizing the backboard against the gameboard rearward edge, and a horizontal slot near the base of the backboard of a size sufficient to receive the gameboard tab and permit the tab to pass through the plane of the backboard.

2. The target assembly of claim 1 comprising two wedge pieces constructed in the approximate shape of a right triangle and wherein the gameboard is of a generally rectangular shape and further comprise two gameboard tab slots.

3. The target assembly of claim 2 further comprising at least one support structure along the forward edge of the underside of the gameboard, wherein the structure supports the forward edge at a height below the height of the backboard horizontal slot.

4. The target assembly of claim 3 comprising two support structures, each one of which is located at opposite corners of the forward edge of the underside of the gameboard.

5. The target assembly of claim 1 wherein the backboard is of a generally rectangular shape and further comprises multiple horizontal slots at varying distances from the base of the backboard.

6. The target assembly of claim 2 comprising two wedge pieces for insertion into each of the gameboard tab slots upon the extension of the tab through the plane of the backboard in such a manner that the base of the right triangle form of the wedge pieces is oriented upward.

7. The target assembly of claim 1 wherein the projectile is a disk.

8. The target assembly of claim 7 wherein the disk projectile is a washer.

* * * * *